United States Patent [19]

Roed

[11] Patent Number: 4,610,365

[45] Date of Patent: Sep. 9, 1986

[54] HOISTING MEANS INCLUDING CONSTANT TENSION HOIST WIRE

[75] Inventor: Harald Roed, Vatne, Norway

[73] Assignee: A/S Hydraulik Brattvag, Brattvag, Norway

[21] Appl. No.: 558,949

[22] Filed: Dec. 6, 1983

[30] Foreign Application Priority Data

Dec. 6, 1982 [NO] Norway ..... 824082

[51] Int. Cl.[4] ..... B66C 23/82

[52] U.S. Cl. ..... 212/262; 212/162

[58] Field of Search ..... 212/162–164, 212/174, 190, 191, 193, 194, 239, 262; 254/273, 277, 315

[56] References Cited

U.S. PATENT DOCUMENTS

| | | | |
|---|---|---|---|
| 1,139,944 | 5/1915 | Wilson et al. | 254/315 |
| 1,357,150 | 10/1920 | Curtis | 212/174 |
| 1,834,985 | 12/1931 | Stoner | 212/152 |
| 3,388,890 | 6/1968 | Born et al. | 254/315 |
| 3,578,787 | 5/1971 | Brickett et al. | 212/164 |
| 3,726,417 | 4/1973 | Nephew | 212/163 |
| 4,200,052 | 4/1980 | Cunningham et al. | 254/315 |

*Primary Examiner*—Trygve M. Blix
*Assistant Examiner*—Stephen P. Avila
*Attorney, Agent, or Firm*—McAulay, Fields, Fisher, Goldstein & Nissen

[57] ABSTRACT

Hoisting arrangement having a boom or a crane with two separately driven hoist wires each with its individual cargo hook. The cargo hooks along with the hoist wires are used for various lifting operations. The hoist wires and a topping wire are operated by their respective winches. The hoist wires are connected via their winches to a common power supply system via a selection valve whereby a constant tension is exerted on the hoist wire. The winches are adapted to pay out hoist wire if the pull in the hoist wire exceeds this constant tension and to draw in hoist wire if the pull falls below the constant tension.

8 Claims, 1 Drawing Figure

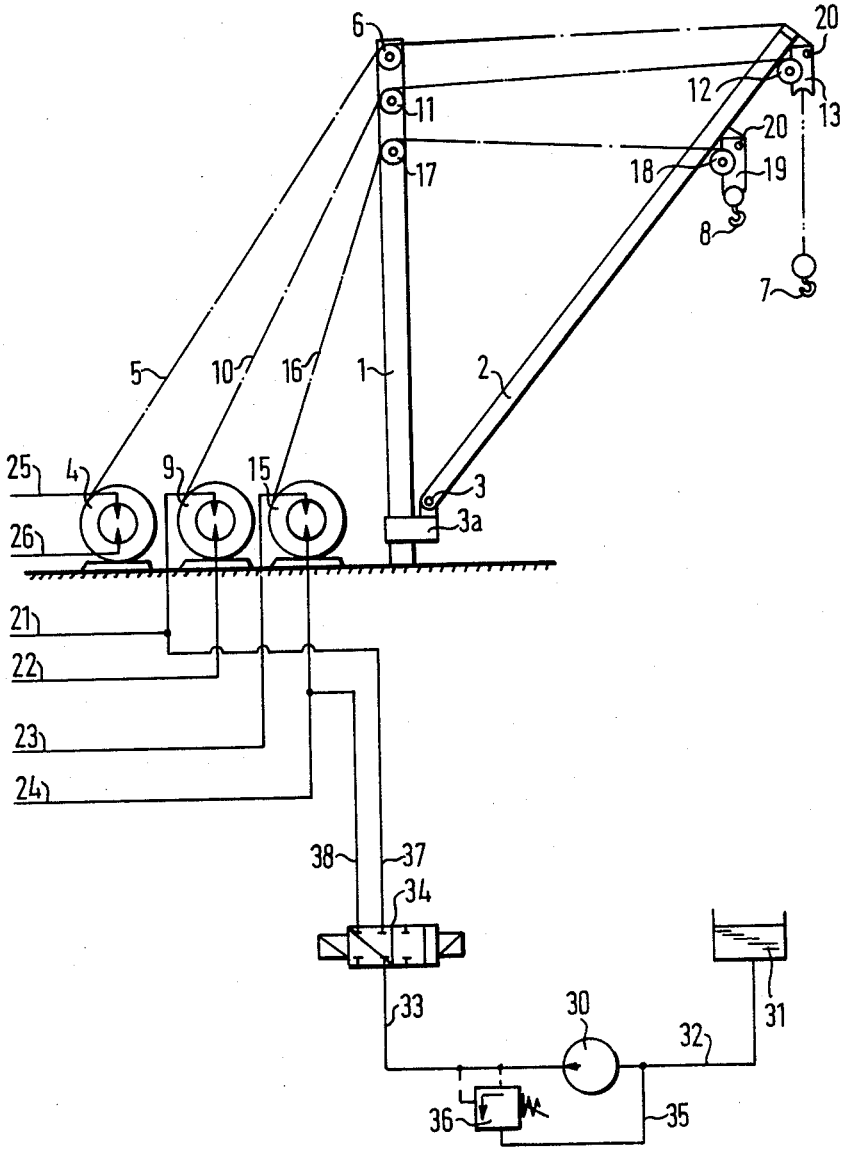
6
20
11
12
13
20
17
18
19
8
7
5
10
16
1
2
25
4
9
15
3
3a
26
21
22
23
24
38
37
34
33
30
31
32
36
35

HOISTING MEANS INCLUDING CONSTANT TENSION HOIST WIRE

This invention relates to hoisting means.

FIELD OF THE INVENTION

In derricks or loading cranes where there are employed two separate hoist wires for operating their respective cargo hooks which are to be used for various hoisting operations, it is customary to allow one wire to act at the outer end of the boom or the crane arm for lifting most actual cargoes, for example, for lifting up to 15 tons, at a relatively great hoisting speed. It is then also usual to allow the other wire to operate in a region of the boom or the crane arm within the outer end of the boom or the crane arm, for hoisting relatively heavy cargoes, for example, for lifting from 15 to 50 tons, and then to operate at a somewhat lower hoisting speed than for the first-mentioned hoist wire. It is consequently important to allow one cargo hook to have an inactive position drawn up under the boom or the crane arm while the other cargo hook is in use. On topping and lowering the derrick or the crane arm, there is a particular need for hauling in and paying out a hoist wire provided with the cargo hook which assumes an inactive position gradually as the derrick or the crane arm is swung. It is possible to operate the operative cargo hook, on the other hand, in parallel with the topping and lowering of the derrick or the crane arm. In certain cases, one cargo hook can be operative while the other cargo hook is adjusted to an inactive position while in other cases the situation can be reversed. There is consequently a need to haul in or pay out the two hoist wires separately when the remaining hoist wire is operative.

In hoisting operations, where for special reasons it is of interest to top and lower the derrick or the crane arm at the same time as one cargo hook is in operation, it has hitherto been customary to allow the inoperative cargo hook to be payed out to a degree sufficient to permit unhindered topping and lowering of the derrick or the crane arm during the hoisting operation. Upon swinging the derrick or the crane arm with sudden movements about a horizontal axis and/or about a vertical axis, it is easy for the inactive cargo hook in a payed out condition to be able to cause damage in an arbitrary manner to neighbouring constructions or persons within the working area of the derrick or the crane arm. Alternatively, the inactive cargo hook can, in individual instances, be thrown upwards over the boom or the crane arm and block the boom or the crane thus causing damage to the hoist wire, topping wire or the like. It is usual for the weight of the cargo hook to be of the order of magnitude of 5% of the lifting ability, that is to say for a hook with a lifting ability of 50 tons the weight of the hook is an estimated 2500 kg.

An object of the present invention, is to provide an arrangement with which by establishing constant tension in the wire of the inactive cargo hook, one can ensure that the inactive cargo hook assumes a parked position near the derrick or the crane arm independently of the movement of the derrick or the crane arm.

A system is known for exerting constant tension on a wire, for example, for mooring of ships to quays where a winch takes in or gives out hawser as the pull varies in the hawser.

SUMMARY OF THE INVENTION

According to the present invention a hoisting means is provided comprises two hoist wires which for use in for various lifting operations each having its respective cargo hook, individual drive means for operating their respective hoist wires and a topping wire, common power supply means connected via a change-over device to said hoist wire-operating drive means whereby a constant tension can be applied to each wire, the latter drive means being adapted to pay out hoist wire if the pull on the hoist wire exceeds said constant tension and to take in hoist wire if the pull on the hoist wire falls below said constant tension.

The anti-slack arrangement according to the invention is applicable for electrically driven as well as for hydraulically driven winches. In the case of hydraulically driven winches, it is preferred that one control conduit of the hoisting winch be connected separately via a selection valve to a common hydraulic control system including a pump in a first conduit connection between the selection valve and a hydraulic oil reservoir and a pressure regulating valve in another conduit connection between the selection valve and the hydraulic oil reservoir.

BRIEF DESCRIPTION OF THE DRAWING

In order that the invention can be more clearly understood, a preferred embodiment thereof will now be described, by way of non-limiting example, with particular reference to the accompanying drawing, whose single FIGURE diagrammatically shows the instant hoisting means.

DISCLOSURE OF BEST MODE OF THE INVENTION

Referring to the drawing, a mast 1 has a derrick 2 which is pivotably mounted about a horizontal axis at a pivot point 3 on a bracket 3*a* on the lower portion of the mast 1. By means of a topping or upper winch 4 actuating associated wire 5, which wire passes over a pulley 6 on the mast and is fastened to the outer end of the boom 2, the boom can be topped or raised and lowered as required.

On the boom 2, there are arranged two separate hooks 7 and 8 which are to be used for various hoisting operations. A first hook 7, which is fastened at the outer end of the boom, is used, for example, for lifting up to 15 tons at a relatively large lifting speed. Another hook 8, which is fastened to the boom at a distance from the first hook 7, is used, for example, for lifting up to 50 tons but at a lower lifting speed than said first hook. The first hook 7 is operated with a first cargo winch 9 via a hoist wire 10 which passes over a first pulley 11 on the mast 1 and another pulley 12 at the outer end of the boom 2. From the pulley 12, the wire 10 passes through a hook stopper 13 which is pivotably mounted on the boom 2 about a horizontal axis as illustrated by pivot pin 20. The other hook 8 is operated correspondingly with another cargo winch 15 via a hoist wire 16 which passes over a first pulley 17 on the mast 1 and another pulley 18 on the boom 2 at a distance from pulley 12 of the wire 10. From the pulley 18, the wire 16 passes through a hook stopper 19 pivotably mounted on the boom about a horizontal axis as illustrated by the pivot pin 20.

The winches 9 and 15 are separately controlled by means of a pair of control conduits 21, 22 and 23, 24, respectively, from their respective control valves (not shown). The winch 4 is provided with a corresponding pair of control conduits 25, 26 from an associated control valve (not shown). The three control valves can preferably be coupled to a common hydraulic system with pump(s), back pressure valves and the like in a manner known per se for conventional operation of the winches 9, 15 and 4 for raising and lowering of cargo and for topping and lowering of the derrick, respectively. On topping and lowering of the boom or derrick 2, there will occur corresponding slackening and tightening, respectively, of the wires 10 and 16.

It is usual to utilise a hook weight of the order of magnitude of 5% of the lifting ability of the hook, that is to say that the weight of hook 8 which is to lift up to 50 tons weighs an estimated 2500 kg, while a hook 7 which is to lift up to 15 tons weighs an estimated 750 kg. On topping of the boom 2, the weight of the hook will ensure that the wire is held tight, the hook being permitted to fall correspondingly outwards from the boom as a consequence of the weight of the hook. On the other hand, on lowering of the boom 2, it is necessary that the wires 10 and 16 be specially released in order that the boom shall be able to be lowered corresondingly.

Provision is made for holding the hook or hooks in initial inactive positions in the associated hook stoppers 13 and 19, respectively, by ensuring a constant tension on the associated wires. An arrangement preferred in practice for such a constant tension system in connection with the illustrated hydraulically driven winches 9 and 15 for the hooks 7 and 8 is shown lowermost to the right of the drawing. There is shown a hydraulic pump 30 which is supplied with hydraulic oil from a reservoir 31 via a first conduit 32 and which supplies hydraulic oil under pressure via a second conduit 33 to a selection valve 34. In a short circuit conduit 35 in parallel across the pump 30, there is inserted a pressure regulating valve 36 which opens when a specific, pre-regulated pressure is exceeded. This pressure can, for example, correspond to the pressure which is to hold the hook 8 in place in the associated hook stopper 19 (weight loading of approximately 2500 kg). There is shown a first conduit connection 37 from the selection valve 34 to the one control conduit 21 for the winch 9 and another conduit connection 38 from the selection valve 34 to the one control conduit 23 for the winch 15. By means of alternative positions of the selection valve 34, there can be supplied as required a pre-regulated hydraulic oil pressure to the respective drive motors of the two said winches 9 and 15 separately. If the pull on the wire 10 (and the wire 16) exceeds the pre-regulated pressure in the valve 36, the winch 9 (and the winch 15) pays out a corresponding length of the wire, the hydraulic oil from the winch being fed backwards to the reservoir 31. If the pull on the wire 10 (and the wire 16) drops below the pre-regulated pressure in the valve 36, the winch 9 (and the winch 15) takes in a corresponding length of the wire, the hydraulic oil being fed to the winch from the reservoir 31.

Instead of using the pump 30 with associated store 31, pressure oil from the hydraulic system which usually controls operation of the winches 4, 9 and 15 also can be used.

While not shown herein in further detail, tightening and paying out of the wires 10 and 16 in a manner corresponding to that described above can be effected by coupling the conduit connections 37 and 38 to pressure medium cylinders instead of to the winches 9 and 15.

It is also possible by electrically driven winches to effect a corresponding tightening and paying out of hoist wires in step with topping and lowering of the derrick by replacing the illustrated hydraulic components with equivalent electrical components. Combination of hydraulic components and electrical components for operation of the winches and for establishing constant tension in the wires also can be resorted to, if desired.

I claim:

1. Hoisting means which includes a mast, a boom or a crane having one end pivoted to said mast about a horizontal axis and comprises:

a plurality of hoist wires each having its own respective cargo hook;

spaced upper, lower and middle pulleys on said mast;

a topping wire passing over said upper pulley and fixed at its outer end to said boom for raising and lowering said boom;

individual hoist wire operating driving means for operating said respective hoist wires and said topping wire;

a plurality of cargo winches each having a hoist wire, one of said hoist wires passing over said lower pulley and the other of said hoist wires passing over said middle pulley on said mast, said hoist wires each having hooks at their outer extremities extending beyond said boom and hook stopping means, one or each said hoist wires, pivotally mounted on said boom for holding said hooks in an inactive position by ensuring said constant tension on said associated wires, said wires passing through said hook stopping means; and common power supply means for said drive means;

a change-over device connecting said power supply means to each said hoist drive means whereby a constant tension can be applied to each wire, each said drive means being adapted to pay out their said respective hoist wire if the pull on the said respective hoist wire exceeds said constant tension and to take in said hoist wire if the pull on said hoist wire falls below said constant tension;

said change-over device comprising a selection valve having alternative positions, a first control conduit connected between said selection valve and said other hoist wire passing over said middle pulley and a second control conduit connected between said selection valve and said one hoist wire passing over said lower pulley, and means for supplying pre-regulated pressure to said respective drive means for each said winches separately.

2. Hoisting means as defined in claim 1, wherein said means for supplying pre-regulated pressure comprises a parallel circuit coupled between a hydraulic oil reservoir and said selection valve, one of said parallel paths including a hydraulic pump for supplying oil under pressure to said selection valve for holding said hooks in said inactive position and the other of said parallel paths including a pressure regulating valve which opens when a specific pre-regulated pressure corresponding to the pressure to hold said hooks in said inactive position

3. Hoisting means having a mast which comprises:

at least two different hoist wires separately associated with its respective pulley on said mast, each said hoist wire having its own individual respective cargo hook;

common power supply means and a change-over device connecting said power supply means to each said hoist means for continuously imparting a constant tension to each said hoist wire, each said drive means controlling the pay out of said respective hoist wire when the pull on each said hoist wire exceeds said constant tension and to take in said hoist wire when the pull on each said hoist wire falls below said constant tension; and said change-over device including:

means for holding said hooks in an operative position in their associated hook stopping means, comprising a hydraulic pump, a selection valve, conduit means connected between said hydraulic pump and said selection valve for supplying pressurized fluid from said pump to said valve, and a short circuit conduit disposed in parallel across said pump and including a resettable regulating valve which opens when a specific, pre-regulated pressure is exceeded to by-pass said pump; and said selection valve being positioned between said short circuit conduit and said drive means for supplying the pressurized fluid to said drive means for retracting or paying out a length of said hoist wires.

4. The invention as defined as claim 3, wherein said fluid is oil.

5. The invention as defined in claim 3, further including a source of supply of fluid connected to said drive means, said fluid being fed backwards to said source when said drive means lets out said hoist wire.

6. Hoisting means which includes a mast, a boom having one end pivotally associated with said mast about a horizontal axis and comprises:

at least two hoist wires each having its own respective cargo hook;

a topping wire having one end fastened to an outer end of said boom for raising and lowering thereof;

a pulley for each said hoist wire and for said topping wire on said mast supported with one pulley above the other aligned with each other and with said pulley for said topping wire being uppermost;

individual wire operating drive means for operating said respective hoist wires separately from each other and together with or separately from said topping wire;

a cargo winch, one for each said hoist wire and said topping wire, passing over said pulleys on said mast;

a hook stopper pivotally coupled with said boom for each said hoist wire for holding said cargo hooks in initial inactive positions by ensuring said constant tension on said associated wires, and said hoist wires passing through said hook stopper, one of said cargo hooks at its outer extremity extending beyond said boom and its said associated hook stopper;

common power supply means for said drive means;

a change-over device connecting said power supply means to said hoist drive means whereby a constant tension can be applied to each said hoist wire, said drive means being adapted to pay out their hoist wire when the pull on said hoist wire exceeds said constant tension and to take in said hoist wire when the pull on said hoist wire falls below said constant tension; and said change-over device comprising a two-position selection valve, a connection between each said cargo winch and said selection valve for controlling and assuring said constant tension on said wires for each said cargo hook, a source of pressure connected with said selection valve through a parallel pressure supplying circuit, one leg of said circuit including means to supply pressure from said source of pressure at a predetermined amount to ensure said constant tension, and the other leg of said circuit including means to by-pass said one leg when a specific pre-regulated pressure is exceeded to hold at least one of said hooks in place.

7. Hoist means as defined in claim 6, wherein in one of said positions of said selection valve, said selection valve and said one parallel path are coupled together to supply pressure to said drive means for each said hoist wire separaetly, and and when a pull in the wire of at least one said hoist wire exceeds said specific pre-regulated pressure determined by a pressure regulating valve in the other leg, a corresponding length of said hoist wires is paid out and when the pull on one of said hoist wires drops below said pre-regulated pressure in said pressure regulating valve, a corresponding length of said hoist wires is paid in or retracted.

8. Hoist means as defined in claim 7, wherein said source of pressure is a hydraulic oil reservoir which supplies oil to said selection valve through one of said parallel paths and returns oil through the other of said parallel paths to said hydraulic oil reservoir.

* * * * *